United States Patent [19]

Fukumochi

[11] 4,304,181

[45] Dec. 8, 1981

[54] PRINTER FOR A DESK COMPUTER

[76] Inventor: Keisuke Fukumochi, 1-54, Sakuramachi, Nishinomiya-shi, Hyogo-ken, Japan

[21] Appl. No.: 95,794

[22] Filed: Nov. 19, 1979

[30] Foreign Application Priority Data

Dec. 13, 1978 [JP] Japan ..... 53-172110[U]

[51] Int. Cl.[3] ..... B41F 5/02

[52] U.S. Cl. ..... 101/232; 101/272; 271/10; 271/129; 271/225; 346/104; 400/531; 400/628

[58] Field of Search ..... 101/66, 266, 277, 232, 101/272, 56, 269; 271/128, 129, 225, 10; 346/104; 400/624, 628, 521, 535, 537

[56] References Cited

U.S. PATENT DOCUMENTS

| | | | |
|---|---|---|---|
| 1,587,417 | 6/1926 | Rojoy Reyes | 271/30 A |
| 1,719,334 | 7/1929 | Marcy | 271/129 X |
| 2,111,640 | 3/1938 | Rider | 271/129 X |
| 2,686,672 | 8/1954 | Leach | 271/133 |
| 2,971,434 | 2/1961 | Pester | 353/114 X |
| 3,285,600 | 11/1966 | Godin | 271/10 |
| 3,330,715 | 7/1967 | Terzuoli | 271/129 X |
| 3,682,376 | 8/1972 | Kawamura | 235/58 P |
| 4,038,922 | 8/1977 | McGregor | 271/129 X |

FOREIGN PATENT DOCUMENTS

| | | | |
|---|---|---|---|
| 239383 | 10/1911 | Fed. Rep. of Germany | 353/106 |

*Primary Examiner*—Edgar S. Burr
*Assistant Examiner*—C. A. Pearson
*Attorney, Agent, or Firm*—Wenderoth, Lind & Ponack

[57] ABSTRACT

A printer for a desk computer includes a card case adapted to accommodate a large number of cards. The cards accommodated in the card case are pressed toward an open end of the card case by a biasing means. A movable frame is adapted to move up and down while keeping in slidable engagement with the open end of the card case. When the movable frame comes down with a card held therein, the card is impressed by the counterrotation of an impression cylinder against the inked printing surface on a plate cylinder.

1 Claim, 4 Drawing Figures

PRINTER FOR A DESK COMPUTER

BACKGROUND AND SUMMARY OF THE INVENTION

The present invention relates to a printer for a desk computer.

With conventional printers for desk computers, numerals are printed on paper tapes. The need for printing the same numeral on a large number of price tags is not fulfilled by the printers of the conventional type.

It is an object of the present invention to provide a printer for a desk computer which fulfills the above-mentioned need.

It is another object of the present invention to provide a printer for a desk computer which is capable of printing successively changing numerals, including the results of an operation performed by a desk computer on a large number of cards fed one by one from a card case.

BRIEF DESCRIPTION OF THE DRAWINGS

With these objects in view which will become apparent from the following detailed description, the present invention will be more clearly understood in connection with the accompanying drawings, in which.

DETAILED DESCRIPTION OF THE PREFERRED EMBODIMENT

Figure 1:
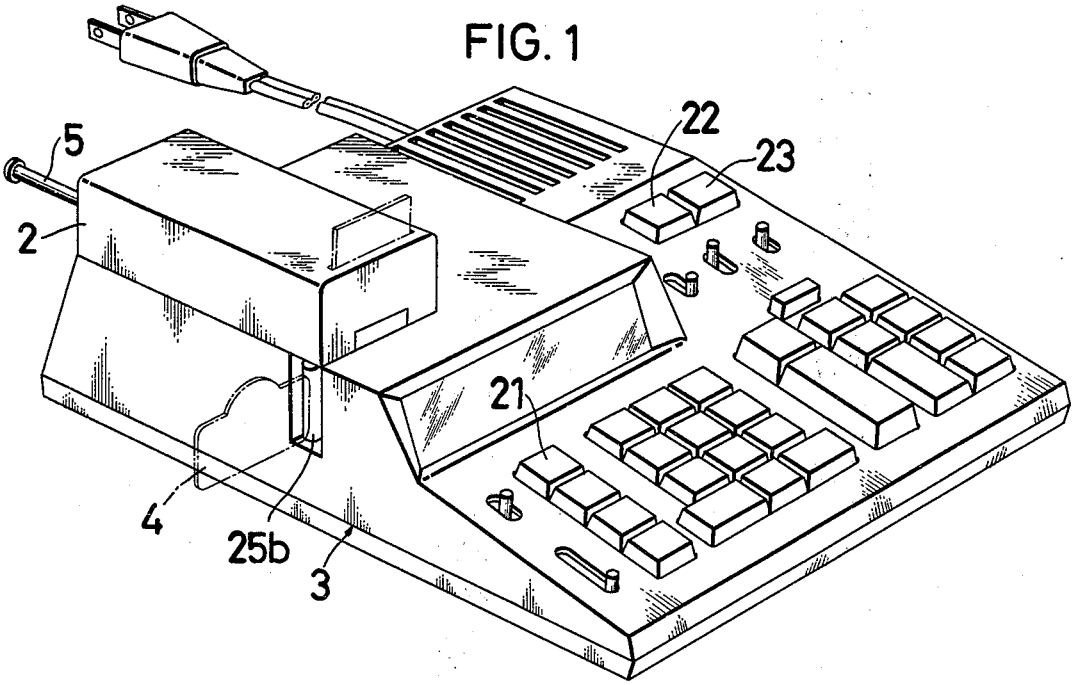
FIG. 1 is a perspective view of a printer according to the present invention mounted on a desk computer.

Referring now to the drawings, a printer in accordance with the present invention includes a card case 1 adapted to be inserted in a housing 2 provided on a desk computer 3. The card case 1 accommodates a large number of cards 4. A rod 5 extends laterally through an end wall 6 provided opposite to an open end 7 of the card case 1. At the inner end, the rod 5 is provided with a perpendicularly disposed plate 8. A spring means 9 fits around the rod 5 in the card case 1 and abuts the end wall 6 of the card case 1 and thus tends to constantly urge the plate 8 into a pressing engagement with the flat surface of the cards 4.

A movable frame 10 is adapted to move up and down while remaining in sliding engagement with the open end 7 of the card case 1. An upright extending plate 11 is provided on the upper part of the movable frame 10. The frame 10 has longitudinal and lateral sidewalls 10*a* and 10*b*. The frame 10 includes a groove or hollow portion 12 which has an outer periphery that is defined by the inner peripheral surfaces of the sidewalls 10*a* and 10*b*. The dimensions of the hollow portion 12 are such that a card can be positioned therein whereby the card edges are adjacent the inner peripheral surfaces of the sidewalls 10*a* and 10*b*. Because of the biasing force of the spring means 9, the cards 4 are constantly pressed against the frame. The lateral walls 20*a* have respectively elongated apertures 12*a* and 12*b* therethrough. Aperture 12*b* is dimensioned such that a card can be slid therethrough, and aperture 12*a* is dimensioned such that the element 20 may be inserted therein when the movable frame 10 is fitted to the open end 7 of the card case 1.

A pair of gears 13 are provided under the card case 1. The rotary motion of the gears 13 is converted into a vertical motion of the movable frame 10 by means of links 14. The links 14 pivotally connect the gears 13 with the lower part of the movable frame 10 by means of pins 27.

Another pair of gears 15 mesh with the gears 13. Arms 16 supporting an impression cylinder 17 are respectively fixed to the gears 15.

A solenoid 18 is provided by the side of the card case 1. When the solenoid 18 carries a current, a movable core 19 is pushed out of, or drawn into, the solenoid 18 so that a piece or element provided on the tip of the movable core 19 is thrusted into, or drawn out of, the slit or aperture 12*a*.

The keyboard of the desk computer 3 includes a push button 21 for starting the printer, a push button 22 for the continuous operation of the printer, and an automatic numbering button 23.

Figure 2:
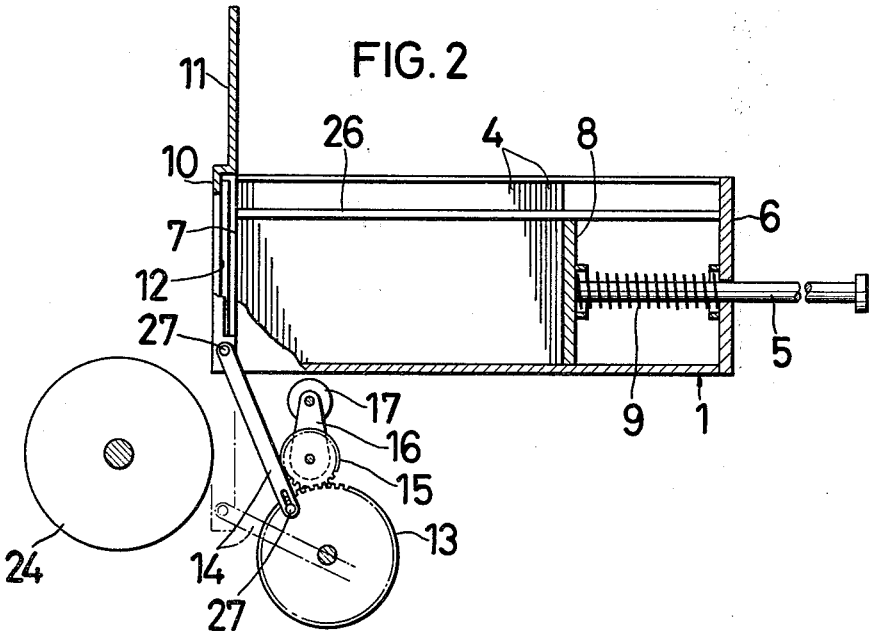
FIG. 2 is a cross-sectional view of the printer.
Figure 3:
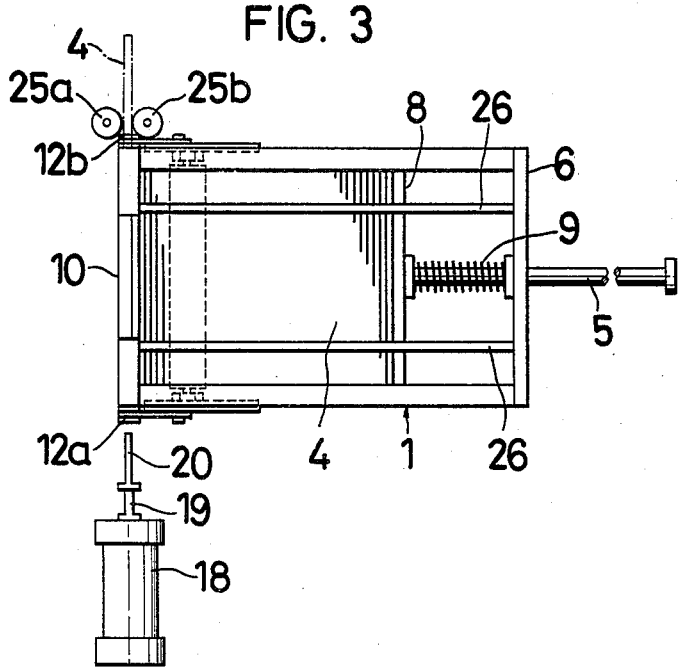
FIG. 3 is a plan view of a printer according to the present invention.
Figure 4:
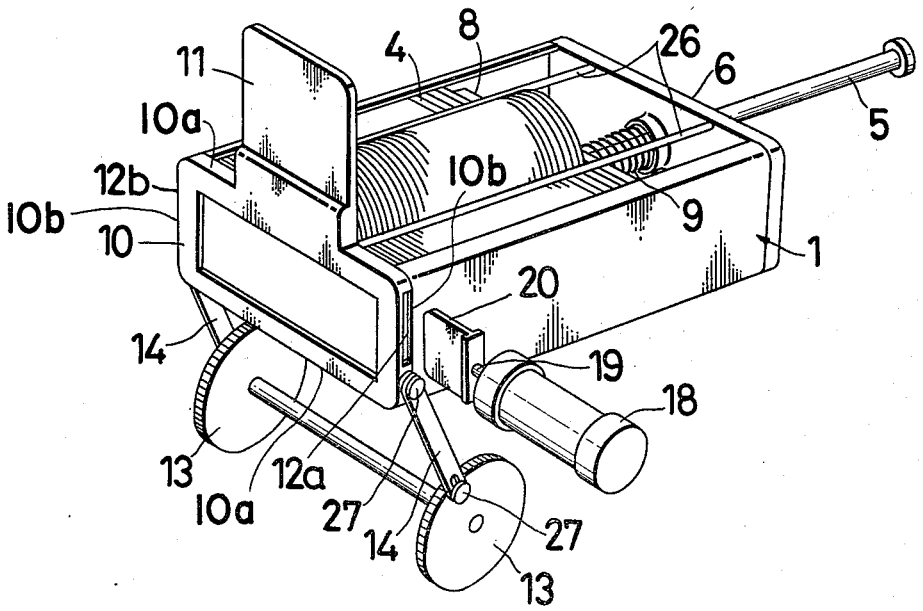
FIG. 4 is a perspective view of a printer according to the present invention.

In operation, when the push button 21 for starting the printer is pushed, the gears 13 turn clockwise as shown in FIG. 2. Subsequently the movable frame 10 descends because the rotary motion of the gears 13 is converted into a vertical motion of the movable frame 10 by means of the links 14. The descending movable frame 10 is accompanied by a card 4 in the groove 12.

While the movable frame 10 is in a lower position, the upright plate 11 keeps the cards 4 from being scattered.

Simultaneously with the clockwise turning of the gears 13, the gears 15 turn counterclockwise and sway the arms 16 such that the impression cylinder 17 is in rolling engagement with the card 4 with the movable frame 10. Then, the card 4 is impressed by the counter-rotation of the impression cylinder 17 against the inked printing surface on a plate cylinder 24.

As soon as the movable frame 10 returns to the position in which the walls 10*a* and 10*b* are adjacent to the open end 7 of the card case 1, the solenoid 18 is energized and thrusts the piece or element 20 into the slit or aperture 12*a*. Consequently, the card 4, which has just been impressed, is pushed out of the side groove 12 through the slit or aperture 12*b* and is held between delivery rollers 25*a* and 25*b* provided at the outlet of the slit 12*b*. The delivery rollers 25*a* and 25*b* transport the card 4 from the case 1 to the exterior thereof as shown in FIG. 1.

Then the next card 4 is thrust into the groove 12 by the spring means 9.

Thus, as the cards 4 are impressed and delivered one after another, the cards 4 accommodated in the card case 1 gradually move toward the movable frame 10 along a pair of guide bars 26 because of the biasing force of the spring means 9.

For the purpose of printing the same numeral on a large number of cards, the push button 22 for the continuous operation of the printer is pushed.

For the purpose of printing successively changing numerals, the automatic numbering button 23 is pushed.

While I have disclosed a preferred embodiment of the present invention, it is to be understood that this embodiment is given by example only and is not to limit the scope of the invention in any sense, rather, the scope of the present invention is determined by the appended claims.

What I claim is:

1. A printing mechanism for a desk computer, said mechanism comprising:

a card case for accommodating cards, said case having an open end;

means for biasing cards accommodated in said case towards said open end;

a movable frame adapted to slidably engage the walls of said case which define the cross-sectional area of said open end, said frame including:

lateral and longitudinal sidewalls inwardly extending toward said case and extending inwardly a distance substantially equal to the cross-sectional width of a card accommodated in said case, said sidewalls being positioned whereby when said frame is in a first position said sidewalls are adjacent to said open end;

a hollow portion having an outer periphery defined by the inner peripheral edges of said sidewalls, said hollow portion being adapted to slidably engage the outer peripheral edges of a card accommodated in said case;

said lateral sidewalls having respective laterally extending apertures therethrough, one of said apertures having a size such that a card accommodated in said case can slidably pass therethrough; and a plate extending in a lateral direction;

said frame being movable in a lateral direction which is substantially parallel to the plane of a flat surface of a card accommodated in said case whereby when said frame is moved from said first to a second position, said plate is slidably adjacent to said open end such that cards remain accommodated in said case;

a first gear means rotatably positioned next to said case;

means for driving said first gear means;

linking means pivotably connecting said first gear means to said frame;

a second gear means rotatably positioned adjacent to and meshing with said first gear means;

an arm fixedly connected to said second gear means;

an impression cylinder rotatably supported by said arm such that when said first gear means is rotated in one direction said linking means moves said frame from said one to said second position and said second gear means rotates in the other direction thereby pivoting said impression cylinder such that it is in rolling engagement with a face of a card positioned in said hollow portion;

a plate cylinder rotatably positioned adjacent to said impression cylinder whereby when said impression cylinder is in said engagement, said plate cylinder is in rolling engagement with the other face of a card positioned in said hollow portion;

means for ejecting a card from said frame when said frame is in said one position by projecting an element through a second of said apertures whereby said element abuts and subsequently slides a card through said one aperture.

* * * * *